United States Patent [19]

Shank

[11] 4,319,543

[45] Mar. 16, 1982

[54] CONTAINER MASKING AND COATING APPARATUS

[75] Inventor: Herbert C. Shank, Lancaster, Ohio

[73] Assignee: Anchor Hocking Corporation, Lancaster, Ohio

[21] Appl. No.: 180,650

[22] Filed: Aug. 25, 1980

[51] Int. Cl.[3] ..... B05B 13/02

[52] U.S. Cl. ..... 118/503; 118/301; 118/324; 118/504

[58] Field of Search ..... 118/301, 504, 503, 324; 198/653, 655, 680

[56] References Cited

U.S. PATENT DOCUMENTS

| | | | |
|---|---|---|---|
| 2,327,668 | 8/1943 | Rempel | 101/114 |
| 2,342,375 | 2/1944 | Shurley | 118/504 |
| 2,600,161 | 6/1952 | Fouse | 118/500 |
| 3,520,086 | 7/1970 | Stevens | 51/14 |
| 3,854,439 | 12/1974 | Harmuth | 118/324 |
| 3,855,966 | 12/1974 | Panas | 118/406 |
| 3,863,753 | 2/1975 | Shank, Jr. | 198/655 |
| 3,886,899 | 6/1975 | Johnson | 118/504 |
| 3,894,630 | 7/1975 | Shank, Jr. | 198/655 |
| 3,967,847 | 7/1976 | Ellis | 294/116 |
| 4,009,681 | 3/1977 | Heckman et al. | 118/504 |

*Primary Examiner*—Ralph S. Kendall

*Attorney, Agent, or Firm*—Wood, Herron & Evans

[57] ABSTRACT

Apparatus for masking a selected area of the neck and/or sidewall of a container and for applying a coating to an adjacent area thereof. The apparatus comprises a container transport conveyor for transporting containers through a coating booth and a side masking conveyor for transporting side masks through the coating booth in parallel with the containers. As the containers move through the booth, the neck of the container is shielded by a neck mask carried by the container transport conveyor and a side portion of each container is shielded by a side mask carried on the side mask conveyor.

17 Claims, 6 Drawing Figures

10

CONTAINER MASKING AND COATING APPARATUS

This invention relates to apparatus for applying a decorative coating or other surface treatment to a limited portion of the outside surface of a container, and more particularly to apparatus for shielding a portion of a container from the surface treatment while another portion of the container is undergoing such treatment.

At certain stages in the manufacture of glass or plastic containers, for example beverage bottles, it may be necessary or desirable to coat or impinge a decorative or other surface material to the body and base of the bottle, while at the same time shielding the finish (or closure receiving portion) of the bottle from the treatment material. The presence of a belt or other carrier beneath the bottle would interfere with the treatment of the base of the bottle. It has therefore been common practice to treat the bottles while they are suspended from a continuously moving conveyor and are passing through a treatment area. The bottles are suspended from chuck assemblies which grip and mask the finish portions of the bottles and prevent the coating or other treatment material from impinging on or being deposited on the finish, or entering into the inside of the bottles.

In general, these container decorating or coating conveyor lines operate upon the principle of suspending the containers from a chuck which incorporates a plurality of movable jaws operable in a closed position to engage a lip of the container finish and support the container thereby. Commonly, the jaws are so configured that when in the closed position, they cooperate to form a substantially closed annulus about the finish portion of the container so as to protect that finish portion from exposure to the treatment material. U.S. Pat. Nos. 3,863,753; 3,894,630; and 3,967,847 disclose such apparatus.

It is sometimes desirable to shield not only the finish portion of the container, but also the neck and/or the side from the decorating or coating treatment. In that event an additional conveyorized shield must be used to protect or mask those additional areas of the container from the treatment material. U.S. Pat. No. 3,886,899 illustrates one form of apparatus for shielding the neck portion of a bottle from a coating process wherein complementary pairs of shields mounted upon opposed conveyors are moved into contact with the neck of the bottle as the bottle is conveyed through the treatment zone. The apparatus disclosed in this patent, however, while it shields the neck of the bottle from the coating treatment, requires two additional conveyor lines to be added to the apparatus to effect the shielding. Manifestly, these additional conveyors add to the expense of the equipment and add equipment which is subject to equipment failure and consequent line down time.

Another shortcoming of the apparatus disclosed in U.S. Pat. No. 3,886,899 is the difficulty of modifying that apparatus to accommodate additional shields for shielding the side as well as the neck areas of bottles. In some applications it is desirable to shield not only the neck of the bottle from the treatment material, but also a sidewall area of the bottle. This additional shielding may require the presence of an additional conveyor movable along the side of the bottle transport conveyor. The apparatus disclosed in U.S. Pat. No. 3,886,899 utilizes conveyors on opposite sides of the bottle conveyor for shielding the neck area of the bottle and therefore leaves little room for the addition of a side mask or shield alongside of the conveyor in the event that decoration or coating of the bottle requires such additional shielding.

It has been one objective of this invention to provide an improved apparatus for applying a decorative or other surface coating to conveyorized containers while shielding the neck area and/or a side area of the container from the treatment material as the containers are conveyed through a treatment zone. This improved apparatus comprises a conveyor for transporting the containers through the treatment zone in line relation and for shielding finish and neck areas of the containers. It also includes a second parallel conveyor for transporting a side shield through the treatment area and for moving the shield into engagement with the sides of the containers, to define a masked sidewall area as the containers are conveyed through the treatment area and for disengaging the shields from the containers after they clear the treatment area.

Still another objective of this invention has been to provide apparatus for shielding the neck area of containers against treatment while the containers are transported through a treatment zone, which apparatus does not require an additional conveyor movable in synchronization with the container transport conveyor, to protect the neck area of the container from the treatment material.

These objectives are achieved and one aspect of this invention is predicated upon the use of a neck shield mounted directly upon and supported from the container chucking assembly of a container transport conveyor such that the container neck area is shielded from treatment without the utilization of auxiliary conveyors to transport those masks or shields in synchronization with the bottle transport.

In general, the container decorating apparatus of this invention comprises two closed loop overhead conveyors, both of which move in parallel through a booth or treatment zone. One of these conveyors is operative to transport containers through the treatment zone and the other is operative to transport a side mask through the treatment zone. The container transport conveyor comprises a plurality of container chucks suspended from an overhead rail conveyor. These chucks are operative to close and thereby grip the finish of a container so that the container is suspended from the finish as it is transported by the conveyor. There is a vertically movable sleeve associated with each chuck which is movable downwardly over the chuck jaws to lock the jaws in a closed position after movement of a container into the chuck. This sleeve carries a floating, vertically movable annular container neck mask in the form of a skirt, which is shiftable vertically to contact the shoulder of a container suspended from a chuck and protect or shield the neck area above the shoulder against treatment within the treatment zone. The side shield conveyor moves in parallel with the container transport conveyor through the treatment zone and is operative to move side shields laterally into engagement with the containers within the treatment zone and then out of engagement with the sides of the containers after the containers clear the treatment zone.

The primary advantage of this invention is its lack of complexity and consequent ease of maintenance. The invention is also subject to being quickly retrofitted with different chuck jaws and different shape neck and side masks so as to accommodate differing size and shape containers.

These and other objects and advantages of this invention will be more apparent from the following description of the drawings in which.

Figure 1:
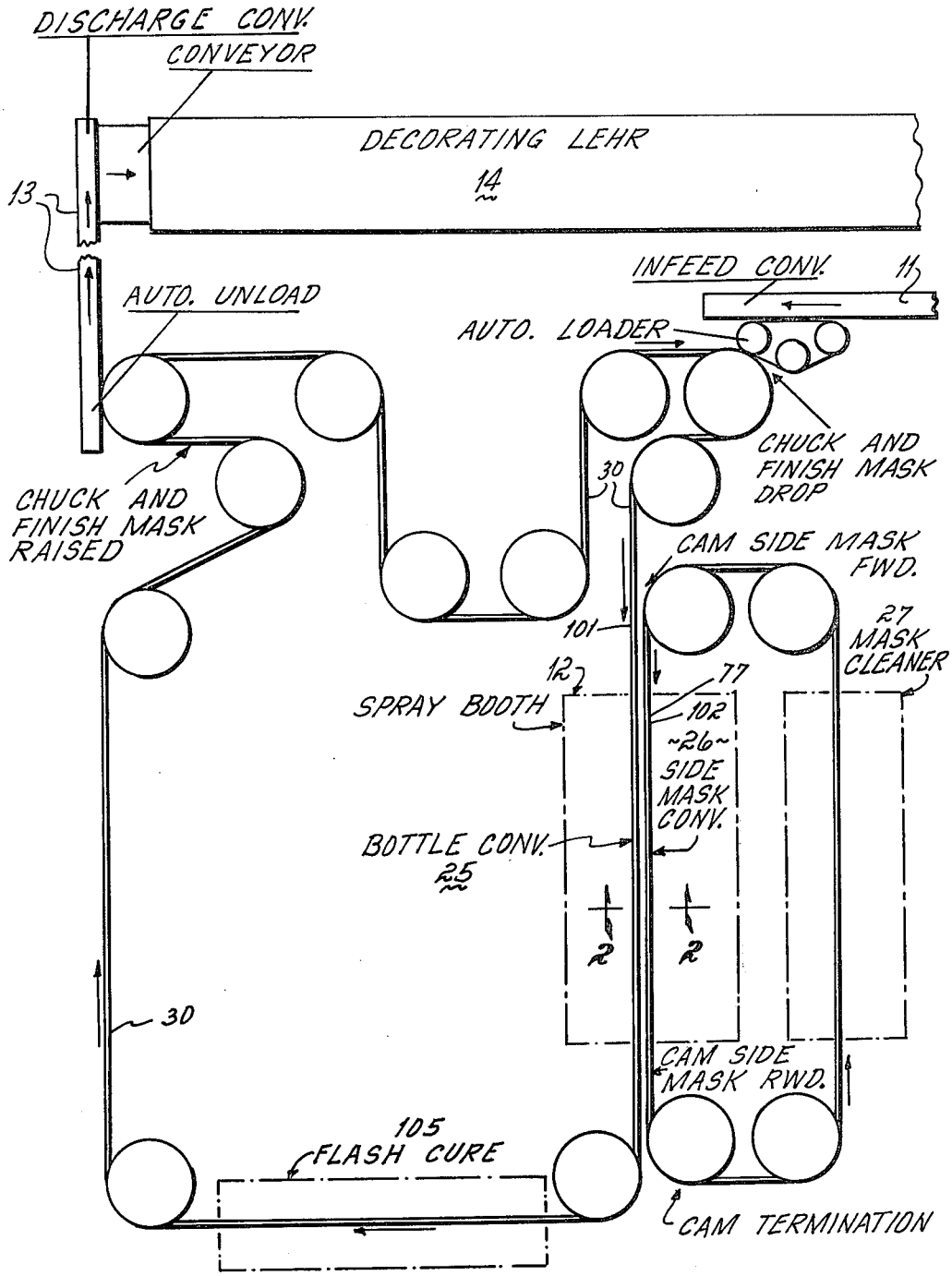
FIG. 1 is a partially diagrammatic illustration of a line incorporating the invention of this application, for decorating beverage bottles by spray application of a glass frit.

Referring first to FIG. 1, there is illustrated a partially diagrammatic top plan view of a bottle decorating line 10 wherein bottles are transported single file to the decorating line 10 via an infeed conveyor 11 and after treatment within a spray booth 12, are deposited onto a discharge conveyor 13. From the discharge conveyor 13, the bottles are transported into a decorating lehr 14, which may be conventional.

In the preferred embodiment of this invention, the bottles are glass bottles which are decorated by having a glass frit coating sprayed onto selected portions of the bottle. That frit is intended to be applied and then subsequently permanently adhered by firing to the surface of a bottle 15 (see FIG. 2) including the base 15*a*, except for a side area 16, the neck 17 and finish 15*b* of the bottle which are to remain clear and free of the decorative fit. In order to maintain the finish 15*b*, neck 17 and side area 16 free of the decorative frit when a bottle 15 is sprayed with such frit in the course of passage through the spray booth 12, those areas 15*b*, 16 and 17 must be masked by a neck mask 18 and side mask 19. The invention of this application is operative to effect placement of those masks into contact with the bottle 15 as the bottle is transported through the treatment zone or spray booth 12.

The bottle decorating line 10 comprises two overhead rail conveyors, a bottle transport conveyor 25, and a bottle side mask conveyor 26. The bottle transport conveyor 25, as explained more fully hereinafter, is operative to mask the neck 17 and finish 15*b* of a bottle and to grasp the finish 15*b* of a bottle in a bottle chuck assembly 24 and while the bottle is suspended from the chuck assembly, to transport the bottle from the infeed conveyor 11, through the spray booth 12, and to the discharge conveyor 13. The side mask conveyor 26 functions to transport a plurality of side masks in synchronization with bottles transported on the transport conveyor 25 through the spray booth 12. As the bottles pass through the spray booth the side mask conveyor is operative to move a side mask 19 into sealing engagement with the side wall 16 of a bottle so as to cover and protect that side wall from exposure to the decorative material applied in the spray booth. After passage through the treatment zone or spray booth 12, the mask conveyor disengages the side mask 19 from the bottle and transports the mask through a mask cleaner booth 27 wherein any decorative material applied to the mask is removed therefrom by a jet of air or any other conventional cleaner to prepare the mask for recycling back into engagement with another bottle as that other bottle passes through the spray booth 12.

Bottle Transport Conveyor

The bottle transport conveyor 25 is operative to propel a plurality of bottle supporting chuck assemblies 24 through a generally rectangular flow path, which path is defined by a drive cable 30 (see FIG. 1). These bottle supporting chuck assemblies 24 are suspended from an overhead rail 31 (FIG. 2) upon hangers 32. The hangers are attached to the cable 30 so that driving movement of the cable effects a corresponding driving movement of the hangers 32 and attached chucks 24.

Figures 2, 3:
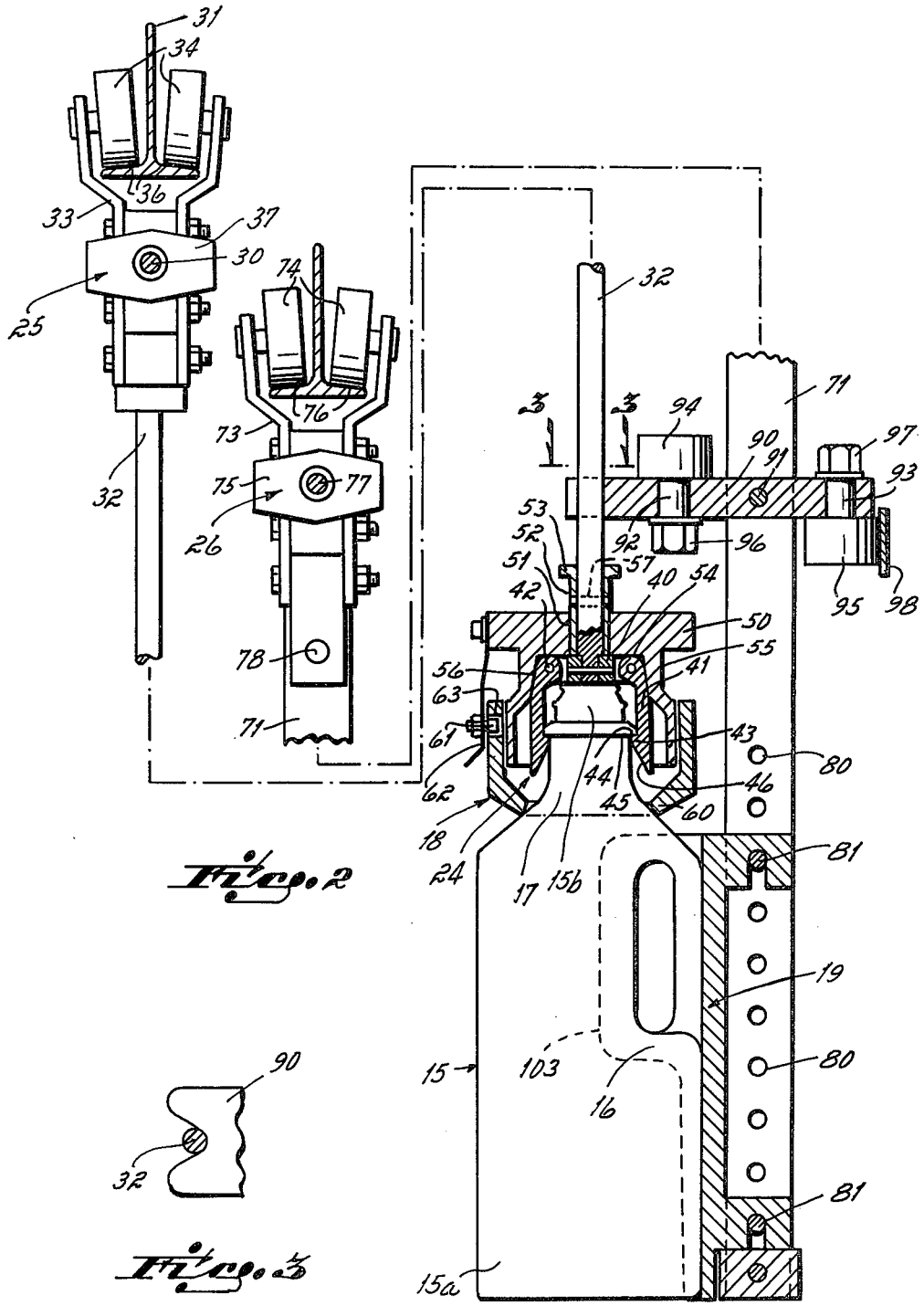
FIG. 2 is a cross sectional view taken on line 2—2 of FIG. 1 wherein a bottle is located in the bottle treatment zone and the bottle neck and side masks are in place to protect those areas of the bottle against treatment within the treatment zone.
FIG. 3 is a cross sectional view taken on line 3—3 of FIG. 2.

With reference to FIG. 2 it will be seen that the upper end of each hanger 32 is secured to a bifurcated fork 33. At its upper end this fork 33 carries a pair of rollers 34 which ride upon the top surface 36 of the inverted T-shaped rail 31. A cable attachment bracket 37 is fixedly secured to the bifurcated bracket 33. The cable 30 passes through the bracket 37 and is secured thereto so that movement of the cable effects a corresponding movement of the rollers 34 over the rail 31 and consequently, movement of the hanger 32 suspended therefrom.

A body 40 of chuck assembly 24 is non-rotatably pinned to the lower end of the hanger rod 32. This body 40 supports a plurality of chuck jaws 41 which are pivotally secured to the body by pivot pins 42. There is a lip 43 extending inwardly from the lower end of each jaw, which lip 43 has a generally horizontal top surface 44 adapted to engage the underside of a thread, ledge or lip 45 formed on the finish 15*b* of a bottle 15. Each jaw 41 has a bottom surface 46 which is tapered upwardly and inwardly from its lower edge so that, as may best be seen in FIG. 5, insertion of a bottle upwardly into the chuck jaws, cams the jaws 41 upon engagement of the finish of the bottles with the bottom tapered surfaces 46 of the jaws. The center of gravity of the jaws, in one embodiment, is such that after insertion of the finish of the bottle into the jaws, and after the finish lip 45 passes upwardly beyond the lips 43 of the jaws, the jaws pivot by gravity inwardly to position the jaw lips beneath the lips 45 of the bottles.

Surrounding the chuck body 40 there is a chuck control sleeve 50 which is slidable on hanger 32. This sleeve 50 has a central bore 51 which fits over and slides upon the external surface of a bushing 52 that is secured to the hanger by a pin 57. A collar 53 at the upper end of bushing 52 limits upward vertical movement of the sleeve on the hanger. Engagement of the bottom surface 54 of this sleeve with the top surface of the chuck body 40 limits its downward movement. Depending from the bottom side of the sleeve 50 there is an annular flange or skirt 55. The inner surface 56 of this flange 55 is tapered downwardly and outwardly for engagement with a correspondingly tapered surface of the chuck jaws 41. When the sleeve 50 is lowered from the position illustrated in FIG. 5 downwardly to the position illustrated in FIG. 2, the tapered surface 56 of the flange 55 engages the tapered shoulders of the chuck jaws to lock those jaws in an inward or closed position.

The bottle chuck assembly including the chuck body 40, the jaws 41, and the sleeve 50, together with the conveyor for transporting that chuck assembly in its closed loop flow path, per se, are not the invention of this application. Rather, the invention of this application resides in the manner in which the bottles are masked and in the masking apparatus. Consequently, the bottle chuck assembly and the conveyor have not been illustrated or described in detail herein. A more complete description of this chuck assembly, as well as a description of the manner in which bottles are inserted into and removed from the chuck assembly, may be found in applicant's U.S. Pat. No. 3,894,630, the disclosure of which is hereby incorporated by reference.

Surrounding the chuck control sleeve 50 and slideable thereon, there is the bottle neck masking sleeve 18. This sleeve has a downwardly and inwardly depending lip section 60 which engages the neck 17 of a bottle when a bottle is inserted onto the chuck. So long as this lip contacts the surface of the neck it seals the neck against the ingress of frit or other coating material onto the neck area.

In the preferred embodiment the mask 18 is attached to the chuck control sleeve 50 by a spring detent pin 61. This pin is suspended from a spring clip 62, the upper end of which is attached to the sleeve 50 and the lower end of which carries the detent 61. The detent fits into a slot 63 which prevents the mask sliding off of the lower end of the sleeve 50. The slot 63 is longer than the detent which fits into it so that the sleeve is free for limited vertical movement on the chuck control sleeve 50. When a bottle is inserted into the chuck, its shoulder 64 (FIG. 4) engages the bottom of the mask and lifts the mark upwardly slightly to insure sealing control between the mask and bottle.

Side Mask Conveyor

The side mask conveyor 26 is also a closed loop conveyor which runs in a generally rectangular path. It passes through the spray booth 12 and when moving through the booth 12 runs parallel to the bottle transport conveyor 25. It too is a cable driven conveyor supported from a fixed overhead rail 70.

With reference to FIG. 2 it will be seen that the side mask conveyor comprises a plurality of masks 19 suspended from vertical hangers 71. At their upper ends these hangers are attached to a bifurcated fork 73, the upper ends of which rotatably support a pair of rollers 74. These rollers ride over the top surface 76 of the inverted T-shaped rail 70 and support the conveyor from the rail. Attached to the bifurcated fork 73 there is a cable bracket 75 having a central aperture through which a cable 77 passes. The bracket 75 is attached to the cable so as to secure the bracket 75 and the attached hanger 71 to the cable. Consequently, as the cable 77 moves through its closed rectangular loop or path of travel (see FIG. 1) it carries the brackets and attached hangers with it.

Figure 4:
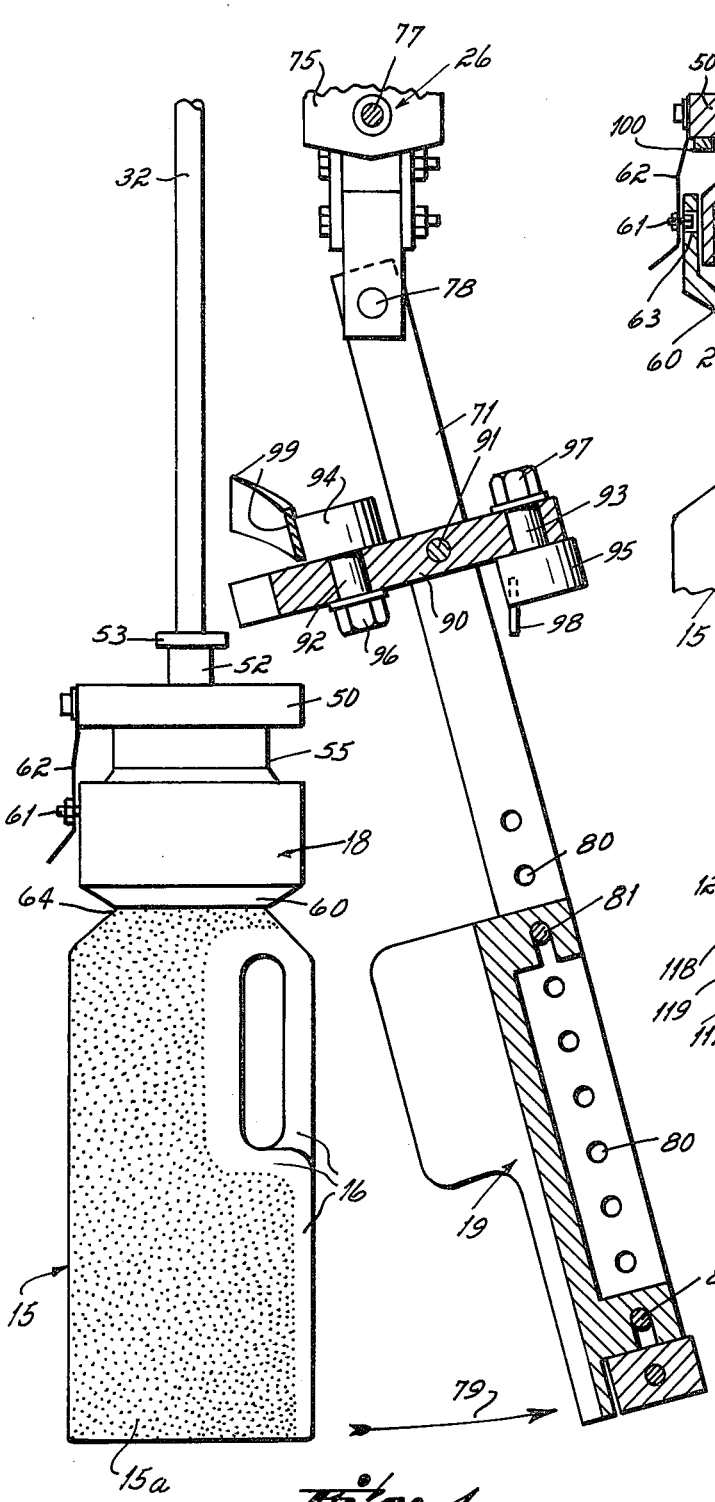
FIG. 4 is a side elevational view, partially in cross section, of the bottle and side mask conveyors after movement of a bottle out of the treatment zone.

With reference to FIG. 4, it will be seen that the hanger 71 is suspended from the bifurcated bracket 73 by a pivot shaft 78. This shaft enables the hanger 71 to be pivoted away from the bottles transported on the bottle conveyor 25 as indicated by the arrow 79, or alternatively moved back into engagement (FIG. 2) with the bottles transported on the line.

With reference now to FIG. 2 it will be seen that the hanger 71 has a plurality of equidistantly spaced apertures 80 extending therethrough at its lower end. The bottle shield or mask 19 is removably hung on the hanger by pins 81 which are secured in place by conventional hitch pin clips, not shown.

The bottle 15 illustrated in FIGS. 1–5 as being decorated or coated on the bottle decorating apparatus 10 of this invention, is illustrated as a handle style bottle such as the style of bottle commonly used for transporting liquor. The decoration apparatus of line 10 though is intended to be utilized to decorated different styles or sizes of bottles and to that end the mask 19 is removable so that a different size and shape mask may be substituted for the side mask 19 to enable the line to be converted to a different size and style bottle.

With reference now to FIGS. 3 and 4 it will be seen that spaced upwardly from the mask on the hanger 71, there is a hanger control bracket 90 attached to the hanger by a threaded fastener 91. This bracket 90 has two vertical bores extending therethrough within each one of which there is mounted a roller support stub shaft 92, 93. A roller 94, 95 is secured to the ends of these shafts and the shafts are attached to the bracket by threaded nuts 96, 97. The roller 94 rests atop the bracket while the roller 95 extends downwardly beneath the bracket. Each roller is engageable by a cam so as to cause the hanger to be moved either toward or away from the bottles 15 transported on the bottle transport line.

With reference to FIG. 2 it will be seen that a plow or cam 98 is engageable with the roller 95 so as to cause the mask to be moved into engagement with the bottles as the bottles are moved through the spray booth 12. When the bottles clear the booth another plow or cam 99 engages the roller 94 so as to cause the mask to be moved away from the bottles as is illustrated in FIG. 4.

Operation

In operation of the decorating apparatus 10, bottles are transported onto the bottle transporting conveyor 25 on the infeed conveyor 11. The infeed conveyor 11 is operative to position each bottle beneath a bottle chuck assembly 24 and to lift the bottle into the open jaws 41 of the chuck, as is more completely illustrated and described in the above identified U.S. Pat. No. 3,894,630. At this point in the travel of the chucks, a cam 100 (FIG. 5) is located beneath the chuck control sleeve 50 and is supporting the sleeve in a raised position.

After the finish **15*b* of a bottle is located within the jaws, the chuck lift cam 100 permits the chuck control sleeve 50 to drop by gravity onto the tapered shoulder of the chuck jaws. The cam surface 56 of the sleeve then locks the jaws in a closed condition in which the lips 44 of the jaws are located beneath lip 45 of the bottle finish. In the course of moving downwardly over the finish of the bottle, the bottle neck mask 18 moves downwardly with the chuck control sleeve until its lower lip 60 engages the shoulder 66 of the bottle. As the bottles are conveyed along the run 101 of the bottle transport conveyor (FIG. 1) and pass through the spray booth 12**, the neck mask remains in a lowered position in engagement with the shoulder of the bottle.

Before the bottles enter the spray booth 12, the side mask 19 is swung into engagement with the side of the bottle. This occurs as a consequence of the cam 98 which runs parallel to the run 102 of the cable 77 engaging the roller 95 on the bracket 90. Since this bracket is attached to the hanger 71, it causes the hanger to pivot inwardly until the mask contacts the side surface 16 of the bottle, thereby shielding the area enclosed by the dotted line 103 (FIG. 3) from decorative frit.

In the course of passage through the spray booth 12 ground glass frit is sprayed onto the bottle from spray nozzles (not shown) directed at the sides of the bottle. The surfaces of the bottle, except the neck 17, finish 15*b* and shielded side area 16, are thus coated with the fine glass frit which is then only loosely adhered to the bottle. As the bottles move out of the spray booth the side mask 19 is pivoted outwardly away from the bottle as a consequence of the plow 99 (FIG. 4) engaging roller 94 of the side mask conveyor and camming the bracket 90 and attached hanger 71 outwardly. The cam mask is then transported through a mask cleaner booth 27 wherein that frit which has adhered to the mask is removed from it by a conventional cleaning technique.

The sprayed and decorated bottles are then conveyed while supported from the bottle chuck 24 through a flash curing booth 105. Within this booth the bottle is subjected to sufficient heat to dry the frit on the surfaces of the bottle. This initial drying forms a sufficient bond between the glass frit and glass bottle to enable the bottle to be handled and particularly to be transferred from the chuck to the unloading conveyor 13 without the frit being dislodged from the bottle.

When the bottle arrives over the automatic unloader, a platform moves up under the bottles and chuck lift cam 100 engages the underside of the chuck control sleeve 50 elevating the sleeves and releasing the bottle. The bottle is then lowered away from the chuck and transferred onto the unload conveyor whence it is transported to the decorating lehr 14.

Opening of the chuck jaws 41 may be effected by tipping of the bottle relative to the vertical axis of the hanger 32 as disclosed in U.S. Pat. No. 3,894,630, or may be effected simply by the weight of the bottle and the configuration of the lip 45 of the bottle camming the jaws to an open position.

Alternative Embodiment

Figure 5:
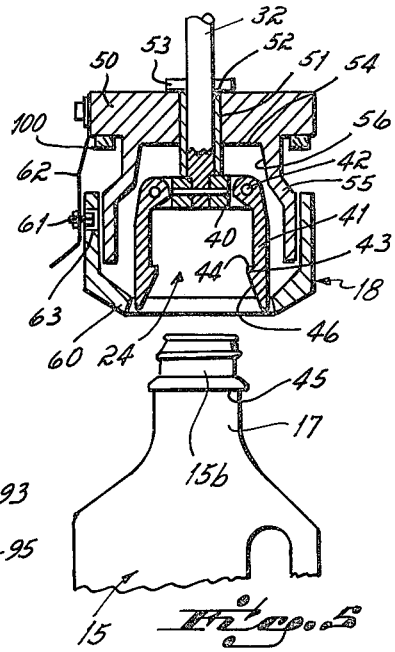
FIG. 5 is a cross sectional view through a bottle chuck assembly prior to insertion of a bottle into the chuck.
Figure 6:
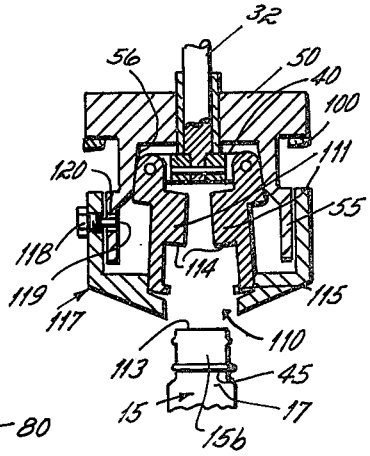
FIG. 6 is a view similar to FIG. 5 but illustrating a slightly modified version of the bottle chuck assembly.

Referring now to FIG. 6 there is illustrated a slightly modified construction of the chuck assembly. This modification 110 of the chuck assembly is in many regards identical to the construction illustrated in FIGS. 1–6, and accordingly those components of the chuck assembly which are identical to the modification of FIGS. 1–6 have been given identical numerals. Specifically, the chuck control sleeve 50 and the chuck body 40 are identical to the sleeve and body of the roller described in the embodiment. In this embodiment though the chuck jaws are normally biased by gravity to an open position as a consequence of the jaws having inwardly extending sections 111 which place the center of gravity of the jaws vertically inwardly from the pivot shafts 42 about which the jaws pivot. In this modification, closure of the jaws is effected by engagement of the top surface 113 of the finish of a bottle with a generally horizontal shoulder 114 of the jaws. When the jaws are closed, this surface 114 is horizontal, but when opened this surface is slightly angulated in a downwardly inclined direction. Engagement of the top surface 113 of the finish of the bottle with the slightly angulated surface 114 causes the jaws to be cammed inwardly and closed. Once moved inwardly, as in the embodiment of FIG. 1–6, lowering of the control sleeve 50 causes the cam surface 56 of the sleeve 50 to engage the shoulders of the jaws and lock the jaws in a closed position in which a lip 115 on the lower edge of the jaws is located beneath a lip 45 of the bottle. With the jaw closed the bottle may be transported about the bottle transport conveyor while suspended from the bottle chuck 110.

The neck mask 18 in FIG. 5 has a circular opening at its lower end, for seating on the shoulder 64 of a bottle which is axially symmetrical. The neck mask 117 of the alternative embodiment shown in FIG. 6 has an oval-sectioned aperture which fits the shoulder of a non-axially symmetrical bottle such as flash type bottle.

The bottle chuck illustrated in this second embodiment also differs slightly from the modification of FIGS. 1–5 in regard to the manner in which the neck mask 117 is suspended from the control sleeve 50. In this embodiment a threaded fastener 118 is threaded into the sleeve end and has a pin section 119 extending into a vertical slot 120 machined into the flange 55 of the sleeve. The slot is substantially longer than the diameter of pin 119 so that the mask 117 is free to float or move vertically on the sleeve 50 to the extent of the slot 120 as in the embodiment of FIGS. 1–5.

In the foregoing description, the container masking apparatus of the invention has been described primarily with reference to its utility in connection with the spray application of a glass frit coating to the container surface. It should be noted however that this apparatus is also useful for masking containers in other types of surface decorating treatments, for example, the conventional surface abrading treatments wherein fine abrasive particles are blown against the surface to lightly "frost" it. In such use the masks function as described, to shield or mask the defined neck and/or sidewall areas from impingement by the abrasive surface treatment material.

While I have described only two modifications of my invention, persons skilled in this art will appreciate numerous changes and modifications which may be made without departing from the spirit of my invention. Therefore, I do not intend to be limited except by the scope of the following claims.

I claim:

1. Apparatus for masking surface areas of containers while they are being transported through a surface treatment area wherein an outside surface portion of each container is impinged with a treatment material and another outside surface portion of each container remains untreated, which apparatus comprises a container transport conveyor movable through said treatment area, a plurality of hangers suspended from said conveyor, a chuck assembly mounted upon the lower end of each hanger, each of said chuck assemblies comprising, a chuck body, a plurality of chuck jaws mounted by said body for movement between an outward open position and an inward closed position, said jaws when in the closed position being engageable with the finish portion of a container supported by said chuck assembly, an annular sleeve movable along said hanger and operative to engage a surface of said jaws so as to maintain said jaws in said closed position, each said jaw having a lip portion engageable when in said closed position, with said finish portion of a container, so as to support said container from said jaws, and a generally annular container neck mask supported from said chuck assembly and engageable with the neck of a container so as to prevent the neck and finish portion of said container from being treated with a treatment material as said container is transported through said treatment area while supported from said chuck assembly.

2. The apparatus of claim 1 in which said container neck mask is supported from said annular sleeve and is vertically movable relative to said sleeve.

3. The apparatus of claim 1 in which said container neck mask surrounds said annular sleeve and is supported therefrom.

4. The apparatus of claim 3 in which said neck mask is supported for limited vertical movement relative to said sleeve.

5. The apparatus of claim 1 in which said jaws are biased by gravity to a closed position.

6. The apparatus of claim 1 in which said jaws are biased by gravity to an open position.

7. The apparatus of claim 1 which further includes means for removably supporting said neck mask upon said chuck assembly.

8. The apparatus of claim 1 which further includes spring clip means for removably supporting said neck mask upon said chuck assembly.

9. The apparatus of claim 1 wherein the neck mask has an oval-shaped central opening to fit the shoulder of a flask-type bottle.

10. The apparatus of claim 1 which further includes a side mask conveyor movable through said treatment area, a plurality of hangers suspended from said side mask conveyor, a container side mask attached to the lower end of each of said hangers of said side mask conveyor, and means for moving each of said side masks into engagement with a sidewall area of a container while said container is supported from one of said chuck assemblies and moves through said treatment area so as to prevent said sidewall area of said container from being treated with the treatment material as the container is transported through said treatment area.

11. The apparatus of claim 10 in which said hangers of said side mask conveyor are pivotally supported from said conveyor.

12. The apparatus of claim 11 in which said mask moving means comprises a cam for biasing said pivoted hangers into a position in which said side masks engage sidewall areas of said containers.

13. The apparatus of claim 12 which further includes a second cam for biasing said pivoted hangers to a position in which said side masks are spaced from said containers when said containers are located outside said treatment area.

14. The apparatus of claim 1 which further includes threaded fastener means for removably supporting said neck mask on said chuck assembly.

15. Apparatus for masking surface areas of containers while the containers are transported single file through a treatment area wherein a portion of each container is treated with a treatment material and another portion of each container remains untreated, which apparatus comprises a container transport conveyor movable through said treatment area, a plurality of hangers suspended from said conveyor, a chuck assembly mounted upon the lower end of each hanger, each of said chuck assemblies comprising, a chuck body, a plurality of chuck jaws mounted by said body for pivotal movement between a radially outward position and a radially inward position, said jaws when in one of said positions being engageable with the finish portion of a container supported by said chuck assembly, each said jaw having a portion engageable when in said one position with said finish portion of a container so as to support said container from said jaws, and a generally annular container neck mask supported from said chuck assembly, said neck mask being vertically movable relative to said chuck assembly and engageable with the neck of a container so as to prevent the neck and finish portion of said container from being treated with said treatment material as said container is transported through said treatment area while supported from said chuck assembly.

16. Apparatus for masking surface areas of containers while the containers are transported through a treatment area wherein an outside surface portion of each container is treated with a treatment material and another outside surface portion of each container remains untreated, which apparatus comprises a container transport conveyor movable through said treatment area, a plurality of hangers suspended from said conveyor, a chuck assembly mounted upon the lower end of each hanger, each of said chuck assemblies comprising, a chuck body, a plurality of chuck jaws mounted by said body for pivotal movement between a radially outward position and a radially inward position, said jaws when in one of said positions being engageable with the finish portion of a container supported by said chuck assembly, a generally annular container neck mask supported from said chuck assembly, said neck mask being vertically movable relative to said chuck assembly and engageable with the neck of a container so as to prevent the neck and finish portion of said container from being treated with a treatment material as said container is transported through said treatment area while supported from said chuck assembly, and a side mask conveyor movable through said treatment area, a plurality of hangers suspended from said side mask conveyor, container side masks attached at their lower ends to the respective hangers of said side mask conveyor, and means for moving each of said side masks into engagement with a container while said container is supported from one of said chuck assemblies and is being conveyed through said treatment area so as to prevent a side portion of the respective container from being treated with the treatment material as the container is being conveyed through said treatment area.

17. The apparatus of claim 16 in which said side mask hangers are pivotally suspended from said side mask conveyor, and said side mask moving means comprises a cam engageable with said hangers to pivot said side mask hangers into engagement with a container supported from said container transport conveyor.

* * * * *